US005356142A

United States Patent [19]

Borg et al.

[11] Patent Number: 5,356,142

[45] Date of Patent: Oct. 18, 1994

[54] PINBALL MACHINE WITH MOVEABLE BALL TRANSFER ASSEMBLY

[75] Inventors: John D. Borg, Lisle; Joseph E. Kaminkow, Arlington Heights, both of Ill.

[73] Assignee: Data East Pinball, Inc., Melrose Park, Ill.

[21] Appl. No.: 103,599

[22] Filed: Aug. 9, 1993

[51] Int. Cl.[5] ..... A63F 7/30

[52] U.S. Cl. ..... 273/121 A; 273/118 A; 273/129 S; 273/129 V

[58] Field of Search ..... 273/108-125, 273/127 R, 129 R, 129 S, 129 T, 129 V, 129 W

[56] References Cited

U.S. PATENT DOCUMENTS 4,840,375 6/1989 Lawlor et al. ..... 273/119 A X
5,120,059 6/1992 Oursler et al. ..... 273/121 A
5,186,462 2/1993 Biagi et al. .

*Primary Examiner*—Vincent Millin
*Assistant Examiner*—Raleigh W. Chiu
*Attorney, Agent, or Firm*—Gerstman, Ellis & McMillin, Ltd.

[57] ABSTRACT

A pinball machine in which a movable ball transfer assembly is provided on the playfield. When a player positions a ball in a selected location on the playfield, the ball transfer assembly is actuated to retrieve the ball, move on the playfield and deposit the ball at different locations on the playfield. The ball deposit location is on a different level of the playfield from the ball deposit location.

29 Claims, 7 Drawing Sheets

PINBALL MACHINE WITH MOVEABLE BALL TRANSFER ASSEMBLY

FIELD OF THE INVENTION

This invention involves a novel pinball machine with a ball transfer assembly.

BACKGROUND OF THE INVENTION

One of the objects of pinball is to move a ball about a playfield so that it may strike different targets and score points. In most prior art machines, the movement of the ball is limited to the initial propulsion made by the player using the ball launching plunger, by flippers and by the action of the ball bouncing off of targets and bumpers. Further, some prior art pinball machines allow movement of the ball on different levels using devices that are hidden from view such as under-playfield ramps and tubes. Such devices effect the desired action of moving the ball without entertaining the player with the viewing of the action.

The present invention allows the movement of the pinball between different levels of the playfield in view of the player. Use of the present invention ordinarily requires skill on the part of the player, in that the ball must be placed so that there is access to the ball transfer assembly and then, by use of the assembly, the ball is transferred to a desired location.

Further, the present invention may provide the player, and spectators, an entertaining view of the pinball being moved from one level of the playfield to another.

It is an object of the present invention to provide a challenging way of moving a pinball to different levels of a playfield, to make more targets accessible and to thereby make the game of pinball more fun and interesting.

Another object of the present invention is to provide a ball transfer device that is simple to construct and is easy to manufacture.

Other objects and advantages of the invention will become apparent as the description proceeds.

SUMMARY OF THE INVENTION

In accordance with the present invention a pinball machine having a housing which carries a playfield is provided. A motor assembly is also provided and is carried within the housing below the playfield. A movable ball transfer assembly, adapted for retrieving and releasing balls is provided in the housing. The ball transfer assembly is movably connected through the playfield to the motor assembly. The motor assembly is actuatable to move the ball transfer assembly from a first location on the playfield, where the ball transfer assembly may retrieve a ball, to a second location on the playfield where the ball transfer assembly may release the ball.

In the illustrative embodiment, the ball transfer assembly comprises an upright rotatable shaft connected to a lateral beam or boom with a substantially U-shaped cross-section and a free end. A cab, a light and other decorative embellishments have been added to the illustrative embodiment to make the ball transfer assembly resemble a construction crane.

The playfield in the illustrative embodiment rises from front to back of the pinball machine at an angle from the horizontal axis of the pinball machine. The boom of the illustrative embodiment is designed to be parallel to the playfield (which is angled with respect to the horizontal axis of the pinball machine) when the boom is facing directly forward or backward, and therefore, is also at an angle with the horizontal axis of the pinball machine. As a result of the angle of the boom, the ball transfer assembly may retrieve a ball from a higher altitude, towards the back of the playfield, and release it to a lower altitude, towards the front of the playfield, merely by turning about its axis. When a ball is so retrieved, the angle of the boom allows the ball to roll into the ball transfer assembly. When the ball transfer assembly is then rotated so that the free end of the boom faces towards the front of the playfield, the ball may roll out of the ball transfer assembly and be released.

In the illustrative embodiment, the ball transfer assembly is used in conjunction with a ball vertical-up-kick assembly. The vertical-up-kick assembly comprises means to project a ball upwardly and a member through which the ball is projected. The member, which is a wire tube in the illustrative embodiment, is attached to the playfield at its proximal end and has a downwardly directed opening at its free distal end. The vertical-up-kick assembly in this embodiment is located rearward, or at a generally higher altitude, from the rotatable ball transfer assembly.

A more detailed explanation of the invention is provided in the following description and claims, and is illustrated in the accompanying drawings.

DETAILED DESCRIPTION OF THE ILLUSTRATIVE EMBODIMENT

Figure 1:
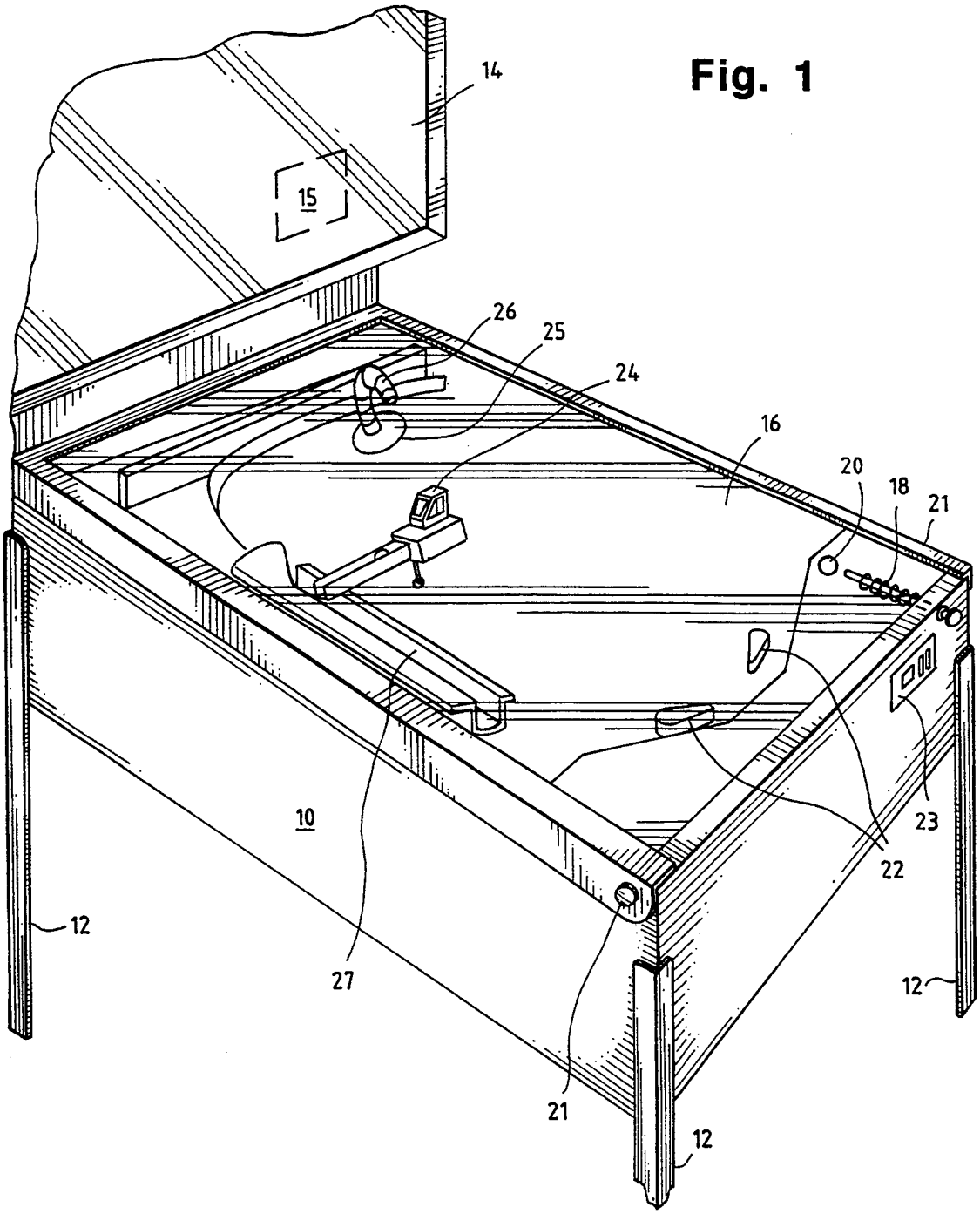
FIG. 1 is a perspective view of a pinball machine constructed in accordance with the principles of the present invention.

Referring to the drawings, FIG. 1 shows a pinball machine comprised of a central body 10 attached to a plurality of legs 12, with a scoreboard 14 and a playfield 16. An electronic circuit including a microcomputer 15 is carried in the pinball machine. A ball launcher 18 is provided to propel a ball 20 onto the playfield 16, where the ball 20 can be struck by a plurality of flippers 22. Flipper control buttons 21 and money accepting means 23 are provided on the central body 10 of the pinball machine. A movable ball transfer assembly 24, secured to playfield 16, and a vertical-up-kick assembly 25, a wire tube assembly 26 and a ramp 27 are provided and explained in detail below.

Figure 2:
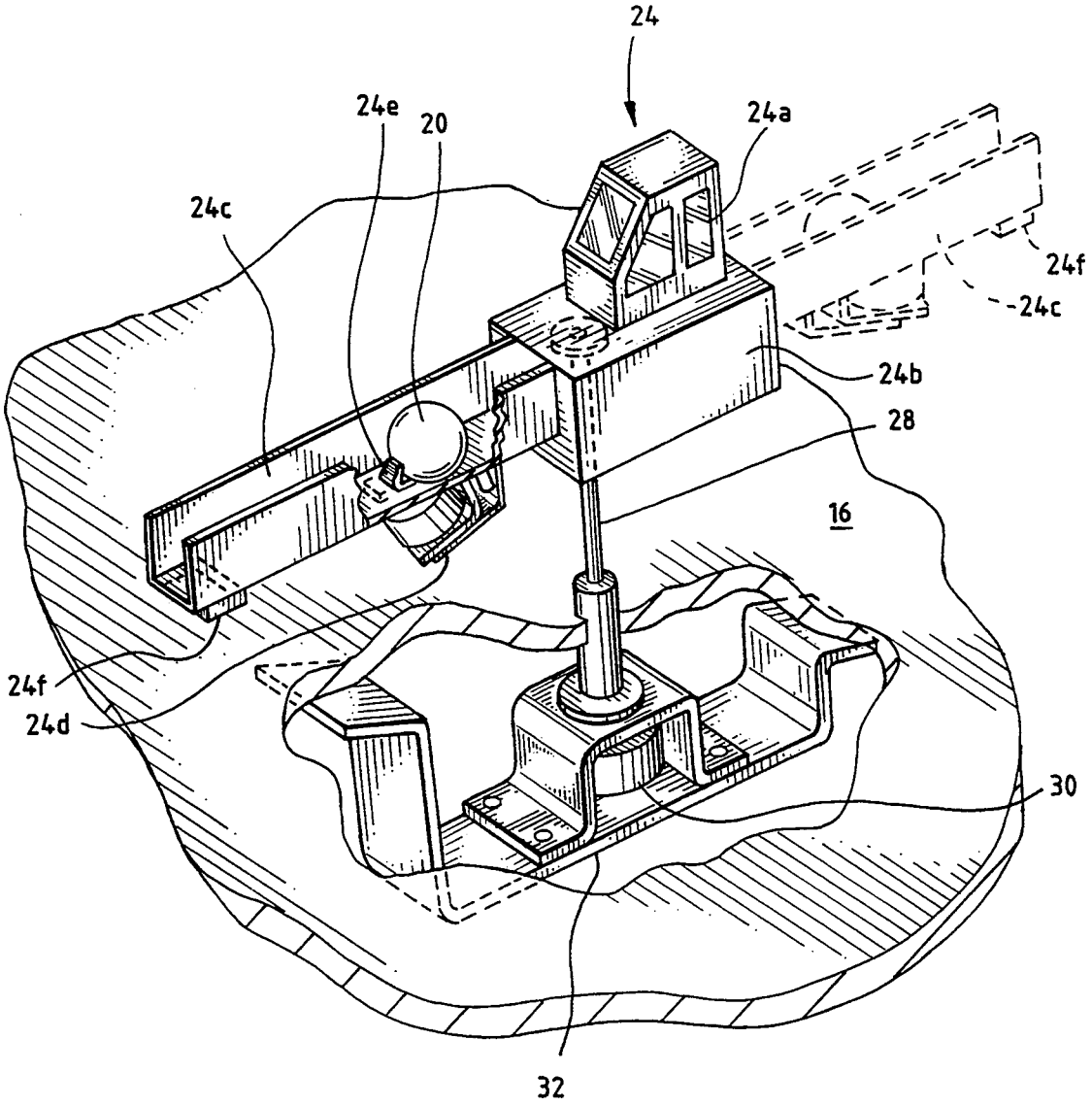
FIG. 2 is an enlarged perspective view, partially broken away, of a ball transfer assembly of the present invention showing the upper and lower portions of the assembly.

FIG. 2 shows the movable ball transfer assembly 24 of the pinball machine of FIG. 1 in greater detail. In the illustrative embodiment, the movable ball transfer assembly 24 rotates about a rotatable shaft 28. Ball transfer assembly 24 is shown in solid lines in the position at which a ball 20 previously retrieved is to be released. A broken line image of the ball transfer assembly 24 showing ball transfer assembly 24 immediately after retrieval of the ball 20 is also illustrated in FIG. 2.

Ball transfer assembly 24 comprises a cab portion 24*a*, a main body portion 24*b*, a boom 24*c*, a switching means 24*d*, a ball stop means 24*e*, and an optional magnetic member 24*f*. The boom 24*c* is illustrated as a member of generally U-shaped cross-section having the capacity to carry a plurality of balls 20 plus switching means 24*d*. The boom 24*c* is attached to main body portion 24*b*. Ball transfer assembly 24 is shown attached to a rotatable shaft 28. Rotatable shaft 28 is shown emerging from beneath playfield 16. Boom 24*c* is shown parallel to playfield 16 which rises from the front to the rear of the pinball machine with an angle, preferably of six degrees. The six degree angle of boom 24*c* and playfield 16 is such that boom 24*c* is accessible to a ball 20 near wire tube assembly 26, where ball 20 can be retrieved and, when the shaft 28 is rotated boom 24*c* is accessible to ramp 27 where ball 20 can be released.

The angle of playfield 16 further allows the use of a magnetic member 24*f*, which is typically an electromagnet. Electromagnet 24*f* may be provided at the end of boom 24*c*. As a result of the angle of the playfield 16, boom 24*c* may be moved so that its free end is close enough to playfield 16 to nearly come into direct contact with a ball 20. In this situation, when ball transfer assembly 24 is activated, microcomputer 15 causes electromagnet 24*f* to be energized and lift ball 20 from the playfield 16. As the ball transfer assembly 24 is rotated ball 20, magnetized to electromagnet 24*f*, is thus moved from its first location to a second location. The microcomputer 15 then turns off the electromagnet 24*f*, and ball 20 is released onto the playfield, or into ramp 27.

Figure 3:
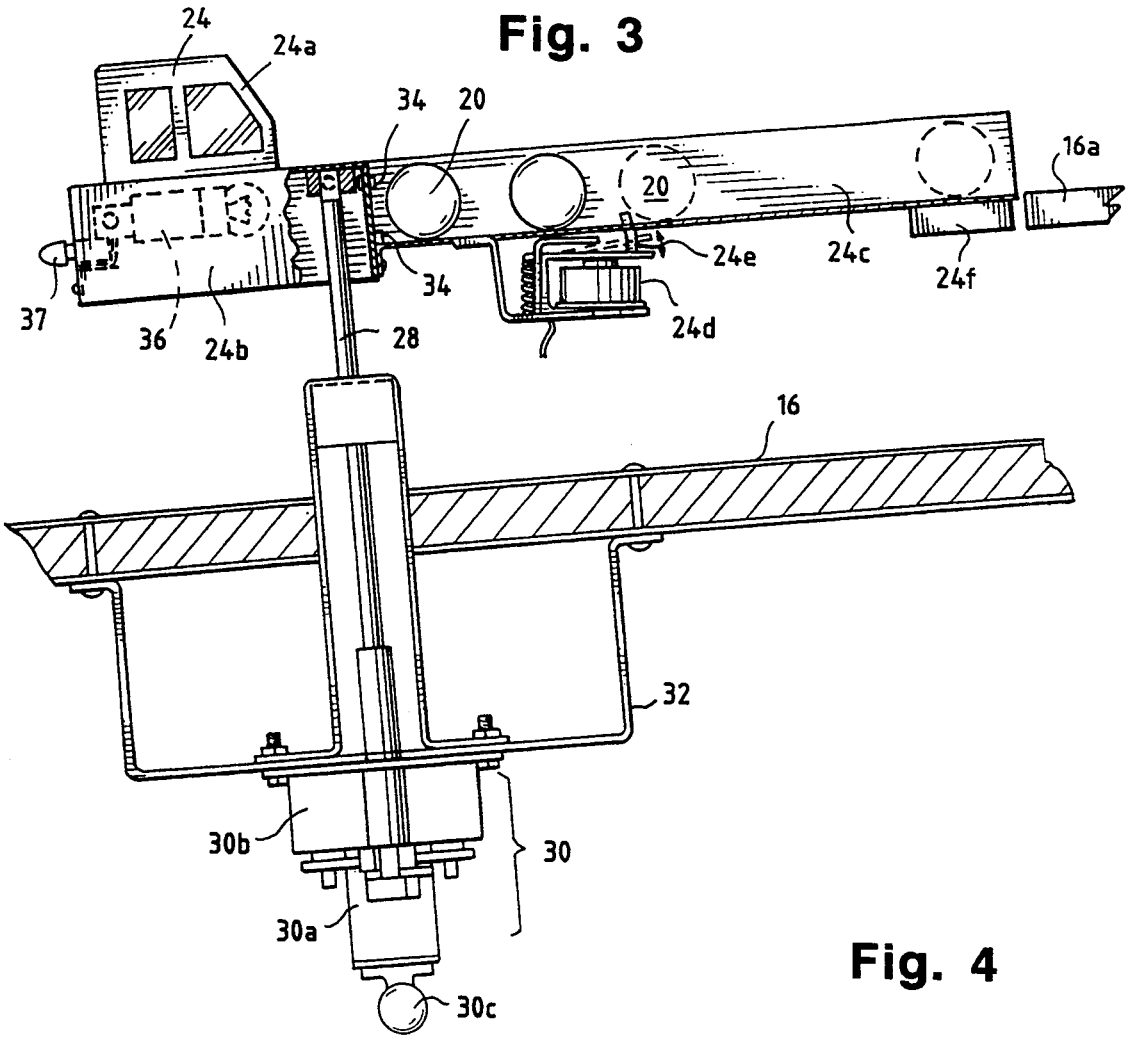
FIG. 3 is a cross-sectional view of a ball transfer assembly of the present invention on the playfield of a pinball machine, showing the assembly in its ball retrieval position.
Figure 5:
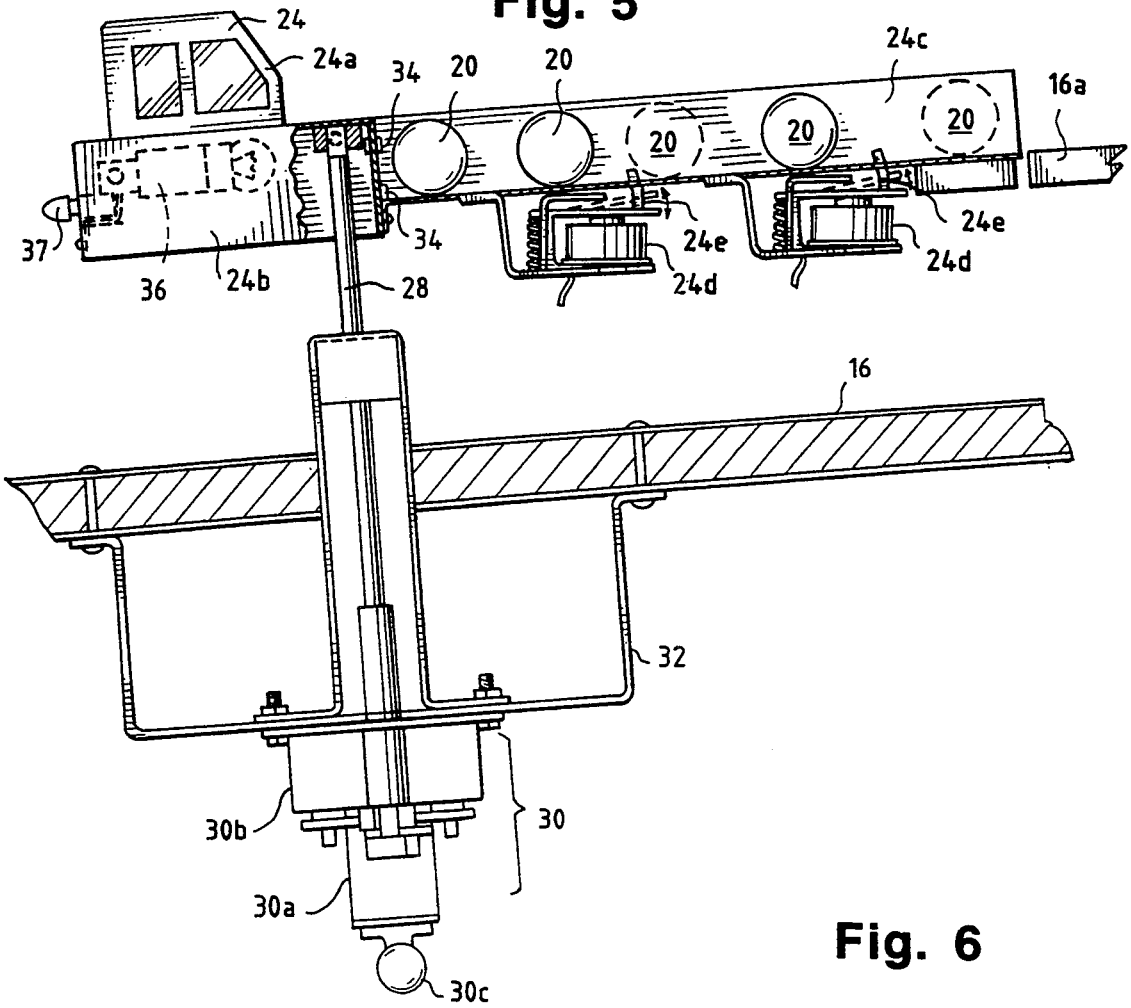
FIG. 5 is a cross-sectional view similar to that of FIG. 3 of a second embodiment of a ball transfer assembly of the present invention in its ball retrieval position.

FIGS. 3 and 5 further show a motor mounting bracket 32 and a motor and gear assembly 30, comprising a motor 30*a*, a gear system 30*b* and a capacitor 30*c*, mounted beneath the playfield 16 and connected to ball transfer assembly 24 by means of rotatable shaft 28. The motor and gear assembly 30 can be of any type, generally allowing the rotation of rotatable shaft 28 in both clockwise and counterclockwise directions as determined by gear assembly 30*b* and microcomputer 15.

FIG. 3 partially illustrates the action of the ball transfer assembly 24. FIG. 3 shows a cross-section of ball transfer assembly 24 and motor and gear assembly 30 mounted under playfield 16 by means of mounting bracket 32, being shown in a ball retrieval position. A ball 20 is retrieved and is caused, by the angle of the shaft 28 to the playfield 16, to roll down the boom 24*c* to rest against the main body portion 24*b*. Sensing switch 34 may be provided to allow microcomputer 15 to recognize the presence of a ball 20 within the ball transfer assembly 24. When a ball 20 has been retrieved, microcomputer 15, activated by ball 20 striking sensing means 34, causes switching means 24*d* to be activated. This causes the ball stop means 24*e* to rise into the boom 24*c*, preventing ball 20 from rolling out of boom 24, and also preventing a further ball 20 from descending into boom 24*c* to a point beyond ball stop 24*e*. Lights 36 and 37 are provided, as shown in FIGS. 3 and 5, on ball transfer assembly 24 for decorative purposes.

Figure 4:
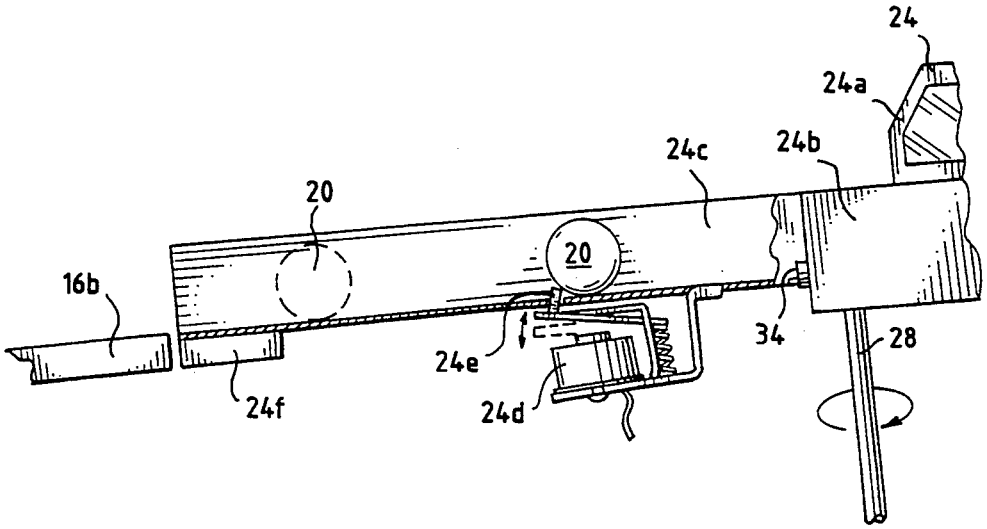
FIG. 4 is a reverse cross-sectional view of a ball transfer assembly of FIG. 3 on a playfield of a pinball machine, showing the assembly in its ball deposit position.
Figure 6:
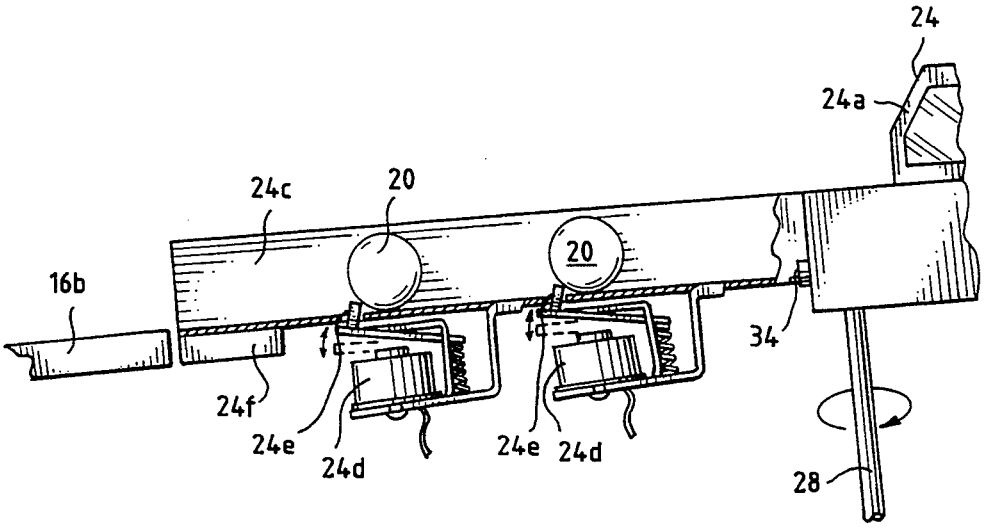
FIG. 6 is a cross-sectional view, similar to that of FIG. 4, of the ball transfer assembly of FIG. 5 in its ball deposit position.

FIGS. 4 and 6 show a partial cross sections of the two embodiments of the ball transfer assembly 24 discussed so far, in ball release positions. In FIGS. 4 and 6 the ball transfer assembly 24 has been rotated about shaft 28 from the respective positions in FIGS. 3 and 5. The free, cantilevered end of boom 24*c* is now lower and can more easily reach ramp 27 after receiving a ball from wire tube assembly 26. Further, the downward angle of boom 24*c*, upon rotation, allows ball 20 to roll forward and, upon release of ball stop means 24*e* by microcomputer 15, out of boom 24*c*.

FIG. 5 shows another embodiment of the present invention in a similar cross section to that of FIG. 3, with an added switch 24*d* and ball stop member 24*e*. Correspondingly, in FIG. 6, two switches 24*d* and two ball stop members 24*e* have been provided. The device of FIGS. 5 and 6 allows the release of one ball 20 and the retention of another ball 20 for release either at a second location or at another time. Although one or two switches 24*d* and ball stop members 24*e* are shown, it is to be understood that any number of switches 24*d* and ball stop members 24*e* can be included without departing from the novel scope of the present invention. Thus providing more complex play situations and ball control.

Figure 7:
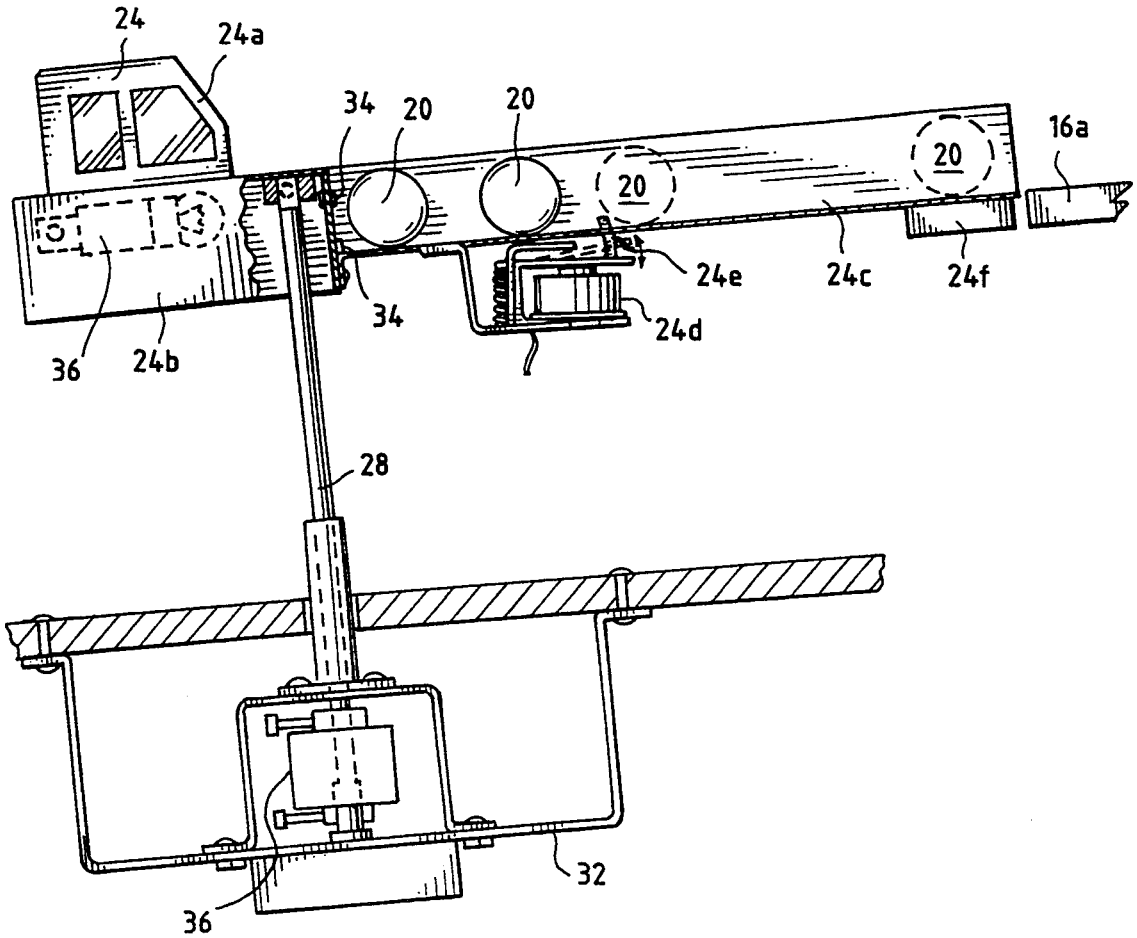
FIG. 7 is a cross-sectional view similar to that of FIG. 3 of another embodiment of a ball transfer assembly of the present invention.

In a further embodiment shown in FIG. 7, a clutch assembly 36 is provided beneath the playfield 16. The clutch assembly 36 is attached to the underside of the playfield 16 by brackets 32. The clutch assembly 36 allows the coupling of the ball transfer assembly 24 to a motor 30*a* (FIG. 3) and allows the motor to be running at speed so that when the clutch assembly 36 is engaged the ball transfer assembly 24 is instantly activated without having to wait for the motor to reach the necessary rpm. In this embodiment switches are provided to determine, as controlled by microcomputer 15, the degree of rotation of rotatable shaft 28 and thereby the positions at which a ball 20 can be retrieved and subsequently released. The remaining parts of the FIG. 7 device are the same as in previous embodiments.

Figure 8:
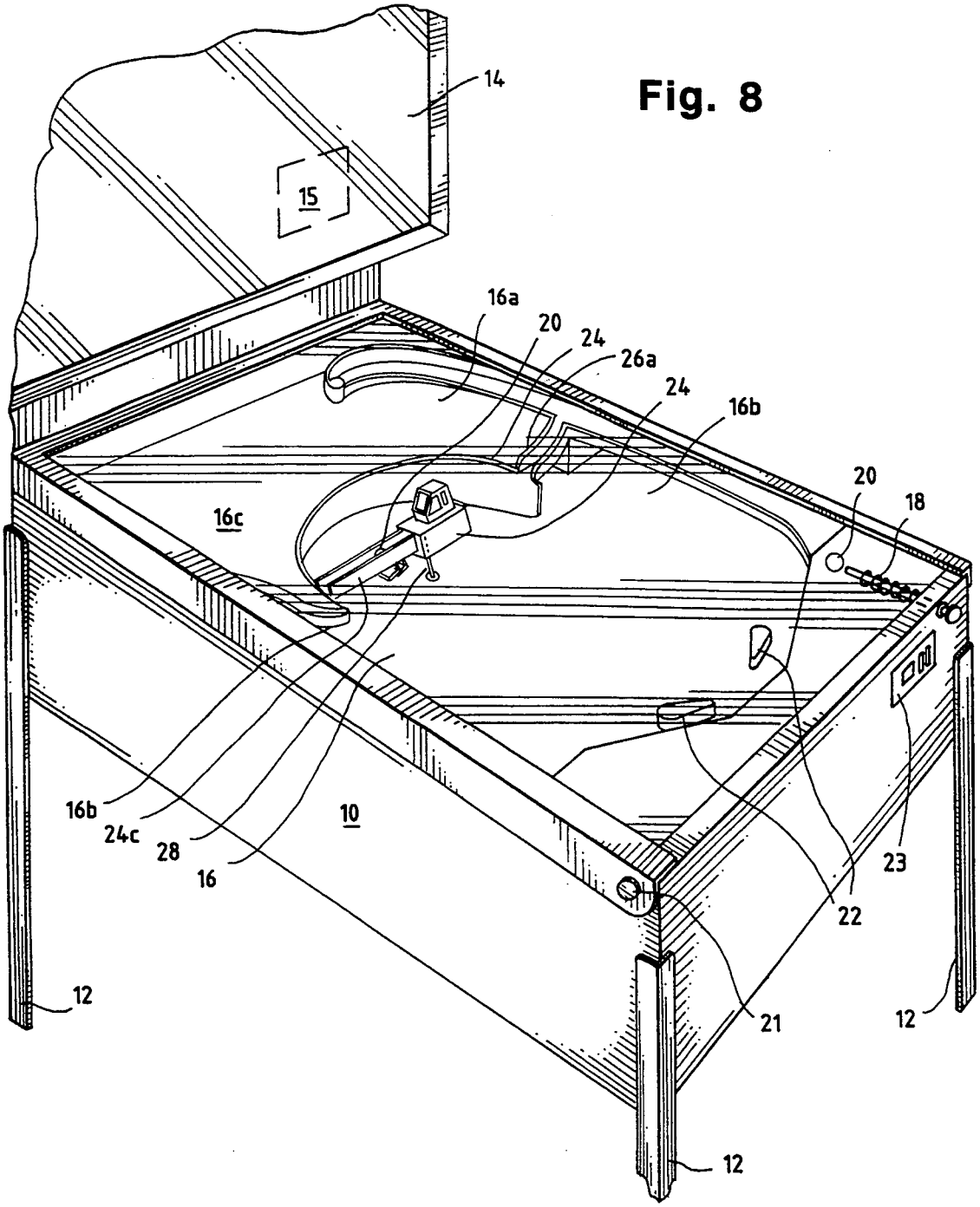
FIG. 8 is a perspective view of another embodiment of a pinball machine constructed in accordance with the principles of the present invention.

FIG. 8 shows a further embodiment of the present invention, similar to previous embodiments except as otherwise indicated. In this embodiment, the playfield 16 is divided into upper level 16*a* and lower level 16*b*. Rotatable shaft 28 is shown emerging from playfield 16 with an angle of rotatable shaft 28 to playfield 16 being other than 90 degrees, typically 4 to 20 degrees. The angle of rotatable shaft 28 to playfield 16 is such that boom 24*c* is accessible to a ball 20 at a chute 26*a*, and when rotatable shaft 28 is rotated, the ball 20 can be smoothly released onto the playfield 16 at any level, 16*a*, 16*b* or 16*c*.

The added angle of the shaft 28 to the playfield 16 makes possible the sweep of boom 24*c* onto the playfield at lower levels than previously described above. Further, in this embodiment playfield upper level 16*a* and lower level 16*b* are made continuous by a sloping plane level 16*c*. In this way, the ball 20 may be smoothly released anywhere on levels 16*a*, 16*b* or 16*c*. The present embodiment thus provides an infinite number of release locations for ball 20 and, therefore, an infinite number of play options in this pinball machine.

Figure 9:
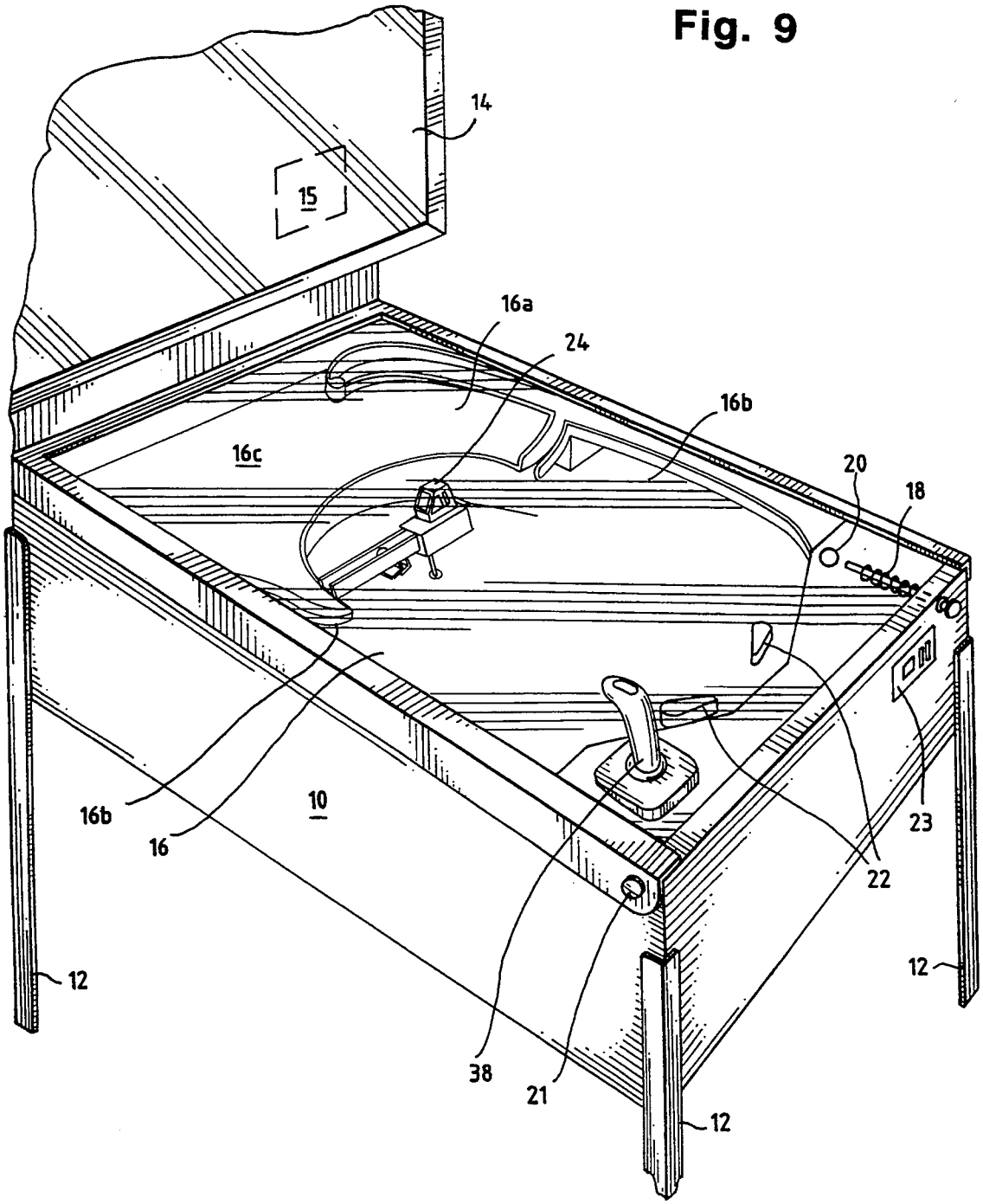
FIG. 9 is another perspective view of the pinball machine of FIG. 8 constructed as a joystick-operated apparatus.

FIG. 9 shows another embodiment of the invention of FIG. 8, similar to previous embodiments except as otherwise indicated. In this embodiment, a joystick 38 is provided. The joystick 38 allows the player of the present invention to partially or fully control the movements and action of ball transfer assembly 24. Joystick 38 can takeover functions where microcomputer 15 is used in any of the previous embodiments.

Although illustrative embodiments of the invention have been shown and described, it is to be understood that various modifications and substitutions may be made without departing from the novel spirit and scope of the present invention.

What is claimed is:

1. A pinball machine which comprises;
a housing which carries a playfield;
at least one ball retrieval location on said playfield;
at least one ball deposit location on said playfield;
a motor assembly within said housing;
a movable ball transfer assembly comprising a boom, said assembly being adapted for retrieving and releasing balls on said playfield from said boom, said ball transfer assembly being movably connected to said motor assembly;
said motor assembly being actuatable to move said ball transfer assembly from said ball retrieval location on said playfield to retrieve a ball, and to move said ball transfer assembly to said ball deposit location on said playfield to release said ball.

2. The pinball machine of claim 1 in which said ball deposit location is on a different level of the playfield than said ball retrieval location.

3. The pinball machine of claim 1, wherein a microcomputer is provided to operate said ball transfer assembly.

4. The pinball machine of claim 1, wherein said ball deposit location comprises a ramp on said playfield.

5. The pinball machine of claim 1, wherein said movable ball transfer assembly is adapted for retrieving and holding a plurality of balls.

6. The pinball machine of claim 1 in which said ball transfer assembly is rotationally connected to said motor assembly and said ball transfer assembly rotates to alternatively retrieve and release balls.

7. A pinball machine which comprises;
a housing which carries a playfield;
at least one ball retrieval location on said playfield;
at least one ball deposit location on said playfield;
a motor assembly within said housing;
a movable ball transfer assembly, adapted for retrieving and releasing balls on said playfield, said ball transfer assembly being movably connected to said motor assembly;
said motor assembly being actuatable to move said ball transfer assembly from said ball retrieval location on said playfield to retrieve a ball, and to move said ball transfer assembly to said ball deposit location on said playfield to release said ball, and
said ball retrieval location comprising a vertical-up-kick assembly and a wire tube member directing a ball retrieved by said vertical-up-kick assembly to said movable ball transfer assembly.

8. A pinball machine which comprises;
a housing which carries a playfield;
at least one ball retrieval location on said playfield;
at least one ball deposit location on said playfield;
a motor assembly within said housing;
a movable ball transfer assembly, adapted for retrieving and releasing balls on said playfield, said ball transfer assembly being movably connected to said motor assembly;
said motor assembly being actuatable to move said ball transfer assembly from said ball retrieval location on said playfield to retrieve a ball, and to move said ball transfer assembly to said ball deposit location on said playfield to release said ball, and
said pinball machine being provided with a joystick to operate said ball transfer assembly.

9. A pinball machine which comprises;
a housing which carries a playfield;
at least one ball retrieval location on said playfield;
at least one ball deposit location on said playfield;
a motor assembly within said housing;
a movable ball transfer assembly, adapted for retrieving and releasing balls on said playfield, said ball transfer assembly being movably connected to said motor assembly;
said motor assembly being actuatable to move said ball transfer assembly from said ball retrieval location on said playfield to retrieve a ball, and to move said ball transfer assembly to said ball deposit location on said playfield to release said ball, and
said ball transfer assembly comprising a boom having a distal and a proximal end, and said distal end comprising an electromagnet for retrieving balls.

10. A pinball machine which comprises;
a housing which carries a playfield;
at least one ball retrieval location on said playfield;
at least one ball deposit location on said playfield;
a motor assembly within said housing;
a movable ball transfer assembly, adapted for retrieving and releasing balls on said playfield, said ball transfer assembly being movably connected to said motor assembly;
said motor assembly being actuatable to move said ball transfer assembly from said ball retrieval location on said playfield to retrieve a ball, and to move said ball transfer assembly to said ball deposit location on said playfield to release said ball, and
said ball transfer assembly comprising a shaft member emerging from beneath said playfield at an angle other than perpendicular to said playfield.

11. A pinball machine which comprises;
a housing which carries a playfield;
at least one ball retrieval location on said playfield;
at least one ball deposit location on said playfield;
a motor assembly within said housing;
a movable ball transfer assembly, adapted for retrieving and releasing balls on said playfield, said ball transfer assembly being movably connected to said motor assembly;
said motor assembly being actuatable to move said ball transfer assembly from said ball retrieval location on said playfield to retrieve a ball, and to move said ball transfer assembly to said ball deposit location on said playfield to release said ball, and
said movable connection having a clutch assembly between said movable ball transfer assembly and said motor assembly to allow said motor assembly to maintain operational speed such that when said clutch assembly is activated said movable ball transfer assembly is immediately operational at said speed.

12. A pinball machine which comprises;

a housing which carries a playfield;

at least one ball retrieval location on said playfield;

at least one ball deposit location on said playfield;

a motor assembly within said housing;

a movable ball transfer assembly, adapted for retrieving and releasing balls on said playfield, said ball transfer assembly being movably connected to said motor assembly;

said motor assembly being actuatable to move said ball transfer assembly from said ball retrieval location on said playfield to retrieve a ball, and to move said ball transfer assembly to said ball deposit location on said playfield to release said ball, and said movable ball transfer assembly comprising a boom having opposed fixed and free cantilevered ends, and said playfield includes at least two levels on which a ball may travel.

13. A pinball machine which comprises;

a housing which carries a playfield;

at least one ball retrieval location on said playfield;

at least one ball deposit location on said playfield;

a motor assembly within said housing;

a movable ball transfer assembly, adapted for retrieving and releasing balls on said playfield, said ball transfer assembly being movably connected to said motor assembly;

said motor assembly being actuatable to move said ball transfer assembly from said ball retrieval location on said playfield to retrieve a ball, and to move said ball transfer assembly to said ball deposit location on said playfield to release said ball, and said playfield rising from front to rear with a slope of about 6° to the horizontal plane of said machine and said ball transfer assembly emerging through said playfield perpendicular to said horizontal plane.

14. A pinball machine which comprises;

a housing which carries a playfield;

at least one ball retrieval location on said playfield;

at least one ball deposit location on said playfield;

a motor assembly within said housing;

a movable ball transfer assembly, adapted for retrieving and releasing balls on said playfield, said ball transfer assembly being movably connected to said motor assembly;

said motor assembly being actuatable to move said ball transfer assembly from said ball retrieval location on said playfield to retrieve a ball, and to move said ball transfer assembly to said ball deposit location on said playfield to release said ball, and said playfield rising from front to rear with a slope of between about 4° and about 20° to the horizontal plane of said machine and said ball transfer assembly emerging through said playfield perpendicular to said horizontal plane.

15. A pinball machine which comprises;

a housing which carries a playfield;

a vertical up-kick assembly and a wire tube assembly defined on said playfield;

a ramp on said playfield;

a motor assembly within said housing carried beneath said playfield;

a rotatably ball transfer assembly, adapted for retrieving and releasing balls on said playfield, said ball transfer assembly being rotationally connected to said motor assembly by a shaft emerging from said playfield;

said motor assembly being actuatable to rotate said ball transfer assembly from said wire tube assembly to retrieve one or more balls, and to rotate said ball transfer assembly to said ramp to release one or more balls.

16. The pinball machine of claim 15, wherein a microcomputer is provided to operate said ball transfer assembly.

17. The pinball machine of claim 15, wherein a joystick is provided to operate said ball transfer assembly.

18. The pinball machine of claim 15, wherein said rotational connection includes a clutch assembly between said rotatable ball transfer assembly and said motor assembly to allow said motor assembly to maintain operational speed such that when said clutch assembly is activated said rotatable ball transfer assembly is immediately operational at said speed.

19. The pinball machine of claim 15 wherein said playfield rises from front to rear with a slope of about 6° to the horizontal plane of said machine and said ball transfer assembly emerges through said playfield perpendicular to said horizontal plane.

20. The pinball machine of claim 15, wherein said playfield rises from front to rear with a slope of between about 4° and about 20° to the horizontal plane of said machine and said ball transfer assembly emerges through said playfield perpendicular to said horizontal plane.

21. A pinball machine which comprises;

a housing which carries a playfield, said playfield including at least two levels on which a ball may travel;

at least one ball retrieval location on said playfield;

at least one ball deposit location on said playfield;

a motor assembly within said housing carried below said playfield;

a rotatable ball transfer assembly comprising a boom having opposed fixed and free cantilevered ends, adapted for retrieving and releasing balls on said playfield, said ball transfer assembly being rotationally connected to said motor assembly by a shaft emerging from said playfield at an angle other than perpendicular to said playfield;

said motor assembly being actuatable to rotate said ball transfer assembly from said ball retrieval location on said playfield to retrieve a ball, and to rotate said ball transfer assembly to said ball deposit location on said playfield to release said ball.

22. The pinball machine of claim 21 in which said ball deposit location is on a different level of the playfield than said ball retrieval location.

23. The pinball machine of claim 21, wherein a microcomputer is provided to operate said ball transfer assembly.

24. The pinball machine of claim 21, wherein a joystick is provided to operate said ball transfer assembly.

25. The pinball machine of claim 21, wherein said free cantilevered end of said boom comprises an electromagnet for retrieving balls.

26. The pinball machine of claim 21, wherein said rotatable ball transfer assembly is adapted for retrieving and holding a plurality of balls.

27. The pinball machine of claim 21, wherein said rotational connection includes a clutch assembly between said rotatable ball transfer assembly and said motor assembly to allow said motor assembly to maintain operational speed such that when said clutch assembly is activated said rotatable ball transfer assembly is immediately operational at said speed.

28. The pinball machine of claim 21, wherein said playfield rises from front to rear with a slope of about 6° to the horizontal plane of said machine and said ball transfer assembly emerges through said playfield perpendicular to said horizontal plane.

29. The pinball machine of claim 21, wherein said playfield rises from front to rear with a slope of between about 4° and about 20° to the horizontal plane of said machine and said ball transfer assembly emerges through said playfield perpendicular to said horizontal plane.

* * * * *